US007171832B2

(12) United States Patent
Umino

(10) Patent No.: US 7,171,832 B2
(45) Date of Patent: Feb. 6, 2007

(54) DOOR LOCK DEVICE

(75) Inventor: Masaaki Umino, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 218 days.

(21) Appl. No.: 10/828,173

(22) Filed: Apr. 21, 2004

(65) Prior Publication Data

US 2004/0221629 A1 Nov. 11, 2004

(30) Foreign Application Priority Data

May 9, 2003 (JP) ..... 2003-131814

(51) Int. Cl.
*E05B 55/04* (2006.01)

(52) U.S. Cl. ..... 70/472; 292/216; 292/DIG. 23

(58) Field of Classification Search ..... 70/472; 292/216, DIG. 23, 41
See application file for complete search history.

(56) References Cited

U.S. PATENT DOCUMENTS

| | | | | |
|---|---|---|---|---|
| 2,477,063 | A * | 7/1949 | Jacobi | 74/579 R |
| 4,934,748 | A * | 6/1990 | Hayakawa et al. | 292/337 |
| 5,709,420 | A * | 1/1998 | Umino | 292/216 |
| 5,813,709 | A * | 9/1998 | Umino | 292/216 |
| 5,842,728 | A * | 12/1998 | Umino | 292/216 |
| 6,739,163 | B2 * | 5/2004 | Reinert | 70/256 |
| 6,779,372 | B2 * | 8/2004 | Arlt et al. | 70/237 |
| 6,918,275 | B2 * | 7/2005 | Martus et al. | 70/240 |
| 6,938,446 | B2 * | 9/2005 | Fukunaga et al. | 70/237 |
| 2005/0140149 | A1 * | 6/2005 | Umino | 292/216 |
| 2005/0218662 | A1 * | 10/2005 | Umino | 292/216 |
| 2005/0253400 | A1 * | 11/2005 | Harada et al. | 292/201 |
| 2005/0258652 | A1 * | 11/2005 | Usuzaki et al. | 292/216 |

FOREIGN PATENT DOCUMENTS

| | | | |
|---|---|---|---|
| DE | 44 19 615 C2 | | 12/1994 |
| DE | 198 23 188 C2 | | 2/1999 |
| JP | 2002-147084 A | | 5/2002 |
| WO | WO 00/75468 | * | 12/2000 |

* cited by examiner

*Primary Examiner*—Suzanne Dino Barrett
(74) *Attorney, Agent, or Firm*—Sughrue Mion, PLLC

(57) ABSTRACT

A door lock device has a lock mechanism configured to allow and not allow opening of a door in an unlocked state and a locked state respectively, and an input shaft configured to switch the lock mechanism between these states when a force is applied to the input shaft. An output shaft is to be engaged with the input shaft so as to transmit the force to the input shaft. The door lock device also has a positioning mechanism configured to hold the input shaft at a position until the output shaft has been engaged with the input shaft and to allow rotation of the input shaft when the engagement has been completed.

9 Claims, 6 Drawing Sheets

DOOR LOCK DEVICE

BACKGROUND OF THE INVENTION

1) Field of the Invention

The present invention relates to a door lock device used in a vehicle.

2) Description of the Related Art

An example of door lock devices is provided with a lock mechanism configured to transmit an action of an opening lever, through an outside handle operated to open a door, to a latch mechanism in an unlocked state. The lock mechanism is also configured to invalidate the action in a locked state so as not to transmit the action to the latch mechanism.

The lock mechanism includes a link portion, which moves to an unlocking position at which the action is transmitted to the latch mechanism and a locking position at which the action is not transmitted to the latch mechanism. The link portion is interlocked with an input shaft rotatably disposed in the lock device. The input shaft is engaged with an output shaft which transmits to the input shaft rotation of a key cylinder operated with a key from outside the vehicle. A recess portion and a projection portion may be provided at the input shaft and the output shaft so as to engage the recess portion and the projection portion and transmit a rotational force between the input shaft and the output shaft. The link portion is connected with a lock button interlocking unit configured to transmit an operation of an inside lock button from inside the vehicle to the link portion.

Rotation of the output shaft by the operation with the key is applied to the input shaft as the rotational drive force. The rotational drive force is then transmitted to the link portion via the input shaft, so that the link portion is switched between the unlocking position and the locking position. On the other hand, the operation of the inside lock button is transmitted to the link portion via the lock button interlocking unit, so that the link portion is switched between the unlocking position and the locking position, as disclosed in Japanese Patent Application Laid-Open No. 2002-147084.

In the door lock device described above, when the key is operated, the link portion moves to the unlocking position or the locking position so as to switch the state of the lock mechanism, and the link portion and the lock button interlocking unit are interlocked so as to operate the inside lock button. On the other hand, when the inside lock button is operated, the link portion moves but the link portion and the input shaft are not interlocked, so that the operation is not transmitted to the key cylinder. That is, the key cylinder is configured such that a direction in which the key is inserted is always the same. In the door lock device, the input shaft is thus connected to the link portion with an idling range in the rotation of the input shaft. That is, movement of the input shaft is transmitted to the link portion so as to move the link portion, but the idling range in which the rotation of the input shaft is idled is provided such that movement of the link portion is not transmitted to the input shaft.

In the door lock device provided with the idling range of the input shaft, the input shaft may be arbitrarily rotated within the idling range even when the input shaft is not engaged with the output shaft. Therefore, the door lock device supplied as a unit element may be assembled to a door such that rotational ranges in which the input shaft is rotated clockwise and anticlockwise for locking and unlocking the door are different from each other. Of course, it is possible to insert the output shaft in the input shaft that has been assembled in this manner. However, in the door lock device in which the output shaft is inserted in the input shaft that has been assembled such that the rotational ranges are different, extents to which the key is rotated to move the link portion to the unlocking and locking positions will be different, too. For example, the extent to which the key is rotated to move the link portion to the unlocking position will be greater than that to move the link portion to the locking position. Consequently, operations with the key will be unnatural to an operator. A rotational phase of the input shaft may be adjusted at the time of assembling the door lock device to the door, but the assembly process of the door lock device will then be complicated.

SUMMARY OF THE INVENTION

It is an object of the present invention to solve at least the problems in the conventional technology.

A door lock device according to an aspect of the present invention includes a lock mechanism configured to allow opening of a door operated by a handle in an unlocked state and to not allow the opening in a locked state; an input shaft configured to switch the lock mechanism between the unlocked state and the locked state when a rotational drive force is applied to the input shaft, the input shaft with which an output shaft is to be engaged so that the rotational drive force is transmitted to the input shaft, the output shaft to be rotated by an operation with a key from outside the door; and a positioning mechanism configured to hold the input shaft at a predetermined rotational position until the output shaft has been engaged with the input shaft and to allow rotation of the input shaft when the output shaft and the input shaft have been engaged with each other.

A door lock device according to another aspect of the present invention includes a lock mechanism configured to allow opening of a door operated by a handle in an unlocked state and to not allow the opening in a locked state; an input shaft configured to transmit a rotational drive force through an output shaft rotated by an operation with a key from outside the door, so as to switch the lock mechanism between the unlocked state and the locked state; and a positioning mechanism configured to hold the input shaft at a predetermined rotational position and to be attachable to and detachable from the door lock device.

A door lock device according to still another aspect of the present invention includes a lock mechanism configured to allow opening of a door operated by a handle in an unlocked state and to not allow the opening in a locked state; an input shaft configured to switch the lock mechanism between the unlocked state and the locked state when a first rotational drive force generated by an operation with a key from outside the door is applied to the input shaft via an output shaft; a positioning mechanism including a plurality of engagement portions configured to engage with each other and to restrict rotation of the input shaft until the output shaft has been engaged with the input shaft so as to engage the output shaft and the input shaft at a predetermined rotational position; wherein a second rotational drive force generated by a lock operation from inside the door is applied to the lock mechanism so as to switch the lock mechanism between the unlocked state and the locked state, and the second rotational drive force applied to the lock mechanism is not transmitted to the input shaft.

The other objects, features, and advantages of the present invention are specifically set forth in or will become apparent from the following detailed descriptions of the invention when read in conjunction with the accompanying drawings.

DETAILED DESCRIPTION

Exemplary embodiments of a door lock device according to the present invention are explained in detail below with reference to the accompanying drawings.

Figure 1:
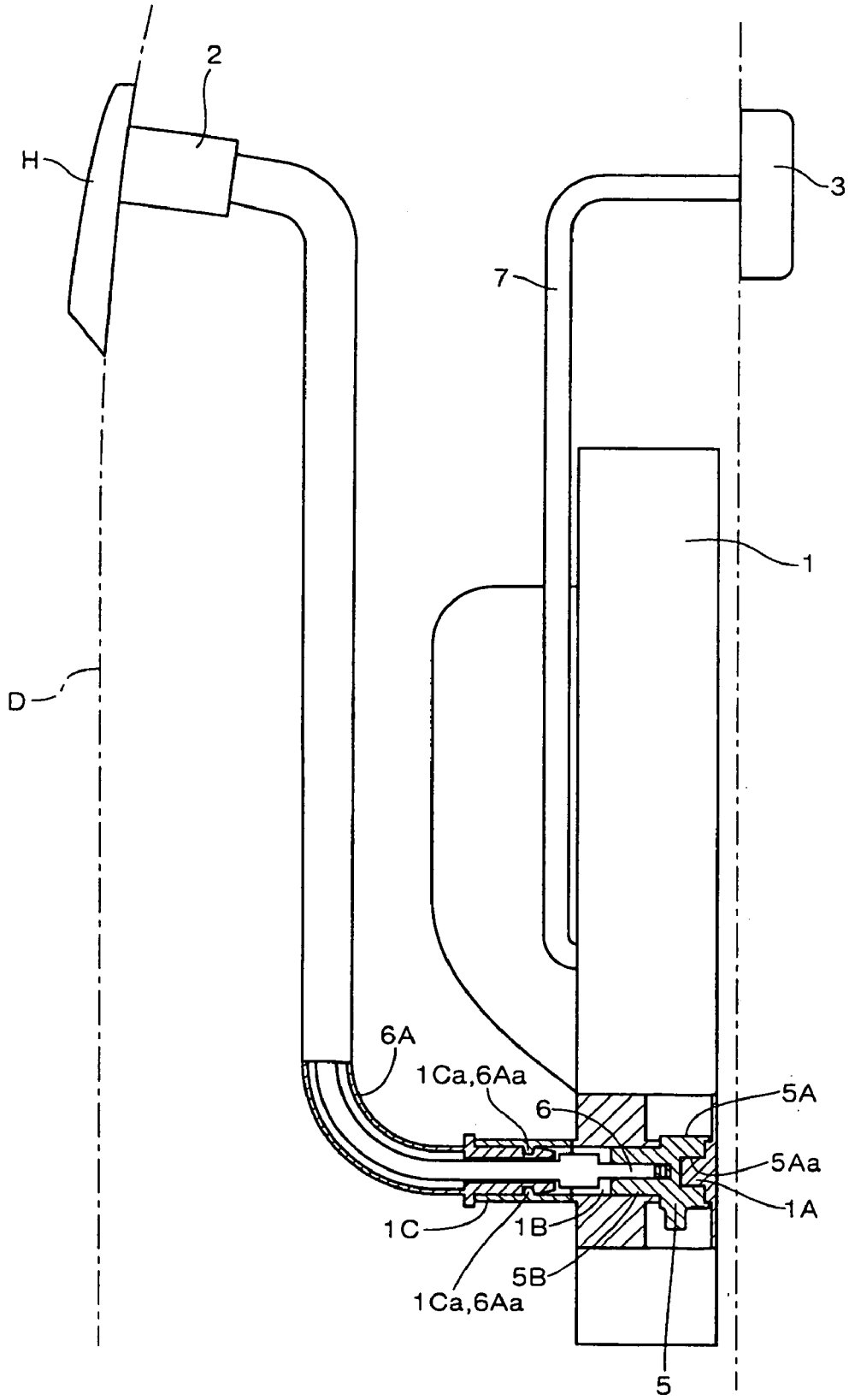
FIG. 1 is an illustration of a door lock device according to a first embodiment of the present invention, viewed from a front of a vehicle.
Figure 2:
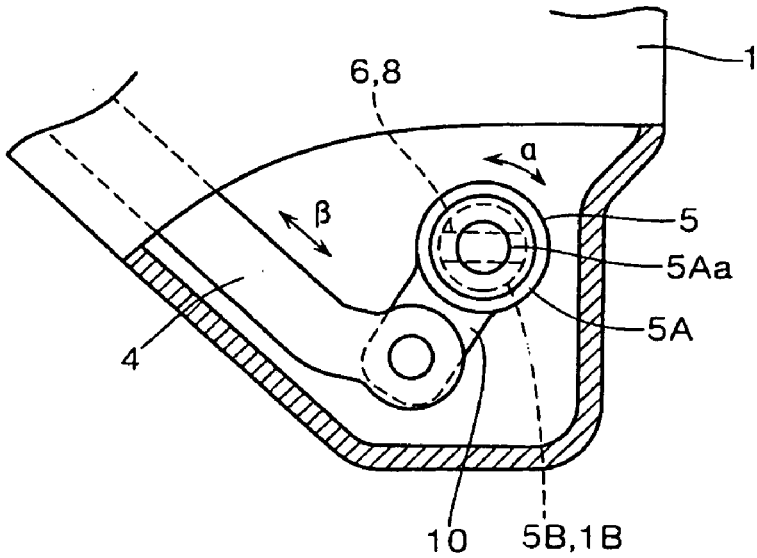
FIG. 2 is an illustration of a portion of the door lock device, which is viewed from inside the vehicle.

FIG. 1 is an illustration of a door lock device according to a first embodiment of the present invention, viewed from a front of a vehicle and FIG. 2 is an illustration of a portion of the door lock device, which is viewed from inside the vehicle.

The door lock device is provided in a side door D (hereinafter, "door") having a front hinge and disposed on a driver's side of a four-wheel automobile (a right-hand drive vehicle in this embodiment). The door lock device is provided between an outside handle H provided on the door D on an outer side of the vehicle and a latch mechanism (not illustrated).

The latch mechanism is accommodated inside a housing 1, and provided with a latch and a ratchet like conventional latch mechanisms. The latch mechanism holds a striker provided in a vehicle main body so as to keep the striker meshed with the latch when the door is closed to the vehicle main body. Further, the latch mechanism holds the door closed to the vehicle main body by keeping, with the ratchet, the latch meshed with the striker.

The door lock device is provided with a lock mechanism (not illustrated) switched between an unlocked state and a locked state through a key cylinder 2 operated with a key and provided in the door D, or through an operation of an inside lock button 3 provided on the door D on an inner side of the vehicle.

The lock mechanism is accommodated in the housing 1, and validates an action of an opening lever rotated through an operation of the outside handle H for opening the door so as to transmit the action to the latch mechanism in the unlocked state. On the other hand, the lock mechanism invalidates the action so as to not transmit the action to the latch mechanism. The lock mechanism is provided with a link portion 4, which moves to an unlocking position at which the action of the opening lever is transmitted to the latch mechanism, and a locking position at which the action is not transmitted to the latch mechanism.

The link portion 4 is connected with an input shaft 5 which transmits a rotation of the key cylinder 2 operated with the key from outside the vehicle to the link portion 4. The input shaft 5 is engaged with an output shaft 6 extending to the key cylinder 2. The link portion 4 is connected to a lock button interlocking unit 7 including a link or a wire for transmitting an operation of the inside lock button 3 from inside the vehicle to the link portion 4. Furthermore, the link portion 4 is connected with a motor interlocking unit (not illustrated) including a gear or the like for transmitting a drive of a drive motor (not illustrated) to the link portion 4.

The operation with the key is transmitted from the output shaft 6 to the link portion 4 via the input shaft 5, so that the link portion 4 is switched between the unlocking position and the locking position. On the other hand, the operation of the inside lock button 3 is transmitted to the link portion 4 via the lock button interlocking unit 7, so that the link portion 4 is switched between the unlocking position and the locking position. The drive of the drive motor is transmitted to the link portion 4 via the motor interlocking unit, so that the link portion 4 is switched between the unlocking position and the locking position.

The inside lock button 3 is configured such that whether the link portion 4 is in the unlocking position or the locking position can be visually distinguished. Further, the drive of the drive motor is transmitted to the link portion 4 via the motor interlocking unit. The drive of the drive motor switches the link portion 4 to the unlocking position with one of forward and reverse drives and to the locking position by the other thereof. Therefore, the motor interlocking unit takes different conformations at the unlocking position and the locking position.

When the link portion 4 is switched to the unlocking position through the operation with the key, the inside lock button 3 and the motor interlocking unit move in cooperation with a movement of the link portion 4 to take one of the conformations corresponding to the unlocking position. Further, when the link portion 4 is switched to the locking position through the operation with the key, the inside lock button 3 and the motor interlocking unit move in cooperation with the link portion 4 to take the other of the conformations corresponding to the locking position. However, when the link portion 4 is moved to the unlocking position or the locking position by the operation of the inside lock button 3 or the drive of the drive motor, the link portion 4 and the input shaft 5 do not move in cooperation with each other, so that the operation is not transmitted to the key cylinder 2. In other words, it is required to always keep a direction in which the key is inserted in the key cylinder 2 the same. Therefore, the link portion 4 and the input shaft 5 are connected to each other with an idling range in the operation of the input shaft 5 so that the link portion 4 is moved via the input shaft 5 but the movement of the link portion 4 is not transmitted to the input shaft 5.

As described above, the input shaft 5, which transmits rotation of the key cylinder 2 operated with the key to the link portion 4 is rotatably supported inside the housing 1. The input shaft 5 includes a rotational base portion 5A and a shaft portion 5B extending continuously along an axis of the input shaft 5. The rotational base portion 5A has an axial hole 5Aa collinear with an axis of the shaft portion 5B. The axial hole 5Aa is a recess formed on an end of the rotational base portion 5A, the end opposite to the shaft portion 5B.

The housing 1 has a projecting shaft 1A which can be inserted into the axial hole 5Aa of the rotational base portion 5A and a bearing hole 1B in which the shaft portion 5B is inserted. The input shaft 5 is rotatably supported between the projecting shaft 1A and the bearing hole 1B.

The bearing hole 1B extends up to outside of the housing 1. The output shaft 6 extending from the key cylinder 2 is inserted into the bearing hole 1B from the outside of the housing 1. In the bearing hole 1B, the output shaft 6 is then engaged with the shaft portion 5B inserted from inside of the housing 1.

In this embodiment, the output shaft 6 extends from the key cylinder 2 and has a rod shape and a flexibility except for an end portion of the output shaft 6 which has an elongated plate shape (for example, having a cross section of a substantially straight line shape) configured to be engaged with the shaft portion 5B. The output shaft 6 is mounted inside an outer cylindrical body 6A having a flexibility. That is, rotation of the key cylinder 2 operated through the key is transmitted to the input shaft 5 by the rotation of the output shaft 6 inside the outer cylindrical body 6A.

Engagement grooves 6Aa are provided on an outer periphery of an end portion of the outer cylindrical body 6A. The bearing hole 1B has an engagement cylinder 1C in which the end portion of the outer cylindrical body 6A is inserted, at an end of an opening of the bearing hole 1B, the opening communicating with the outside of the housing 1. Engagement projections 1Ca configured to be engaged with the engagement grooves 6Aa are provided on an inner peripheral surface of the engagement cylinder 1C. The outer cylindrical body 6A is inserted in the engagement cylinder 1C so that the engagement grooves 6Aa and the engagement projections 1Ca are engaged with each other. Consequently, the output shaft 6 is prevented from falling off from the bearing hole 1B and the end portion of the output shaft 6 which extends from the end portion of the outer cylindrical body 6A is held engaged with the input shaft 5.

Figure 3:
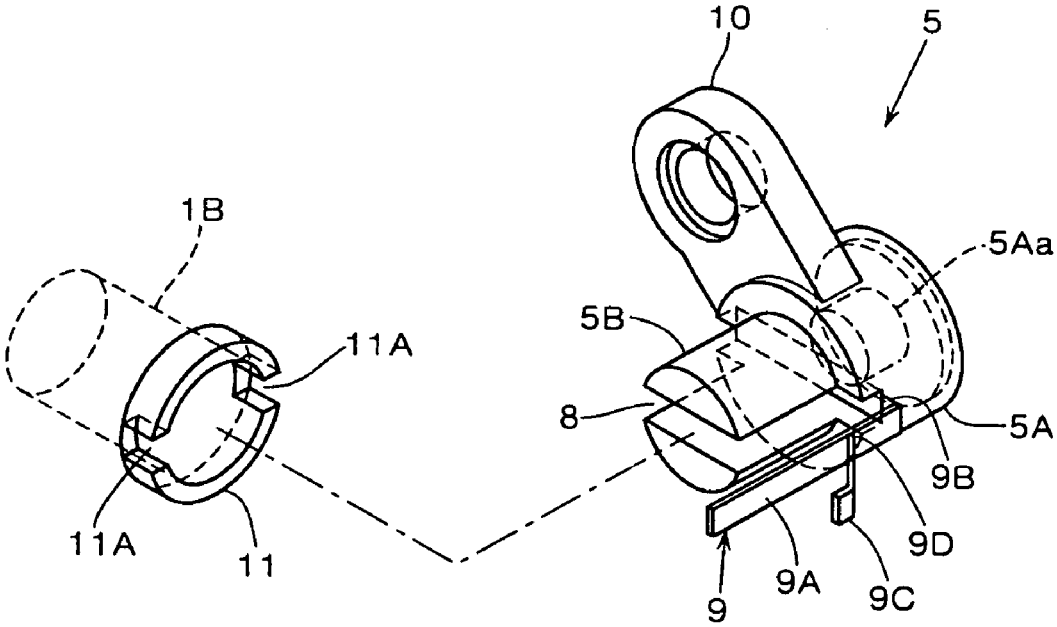
FIG. 3 is a perspective view of an input shaft and a bearing hole according to the first embodiment.

Details of the input shaft 5 and the bearing hole 1B will be explained below. FIG. 3 is a perspective view of the input shaft and the bearing hole of the first embodiment. As illustrated in FIG. 3, the rotational base portion 5A of the input shaft 5 has a cylindrical shape. The shaft portion 5B having a cylindrical shape and a diameter smaller than that of the rotational base portion 5A is provided unitarily with the shaft portion 5B at an end portion of the rotational base portion 5A. Another end portion of the rotational base portion 5A has the axial hole 5Aa.

The shaft portion 5B has a recessed groove 8 as an element of a positioning unit. The recessed groove 8 has a substantially straight line shape and longitudinally divides the shaft portion 5B in two along the axis of the shaft portion 5B. The recessed groove 8 extends into a portion of the end portion of the rotational base portion 5A.

An outer peripheral portion of the rotational base portion 5A has an engagement member 9 as another element of the positioning unit. The engagement member 9 has an engagement piece 9A, which can penetrate through the recessed groove 8 from a side of an opening formed by the groove 8 to an opposite side of the opening. The engagement piece 9A is cantilevered with its end connected to the rotational base portion 5A via a resilient portion 9B, at an edge of a side opening of the recessed groove. The edge is continuous with a bottom portion of the recessed groove 8. Further, an abutting piece 9C serving as an abutting portion extends from an intermediate portion of the engagement piece 9A. The abutting piece 9C is cantilevered with its end connected to the engagement piece 9A via a resilient portion 9D having a hardness and a resilient force higher than those of the resilient portion 9B. The abutting piece 9C extends obliquely outward from the engagement piece 9A. A free end of the abutting piece 9C is configured to be placed in the recessed groove 8 and to extend toward an end of the shaft portion 5B, when the engagement piece 9A is inserted in the recessed groove 8.

A coupling arm member 10 extending radially outward is provided on an outer peripheral portion of the rotational base portion 5A. The coupling arm member 10 is configured to be connected to the link portion 4.

As illustrated in FIG. 3, the bearing hole 1B defines an inner diameter for allowing insertion of the shaft portion 5B of the input shaft 5 and for rotatably supporting the shaft portion 5B. The bearing hole 1B has a cylindrical portion 11 at an end of an opening of the bearing hole 1B, the opening facing the inside of the housing 1. The cylindrical portion 11 has an inner diameter for allowing insertion of the shaft portion 5B of the input shaft 5 and for rotatably supporting the shaft portion 5B, like the bearing hole 1B. The cylindrical portion 11 has notched grooves 11A as still another element of the positioning unit. The notched grooves 11A are provided at positions at an end of the cylindrical portion 11 directed toward the inside of the housing 1 and the positions are opposed to each other. The notched grooves 11A are configured to be in communication with the recessed groove 8 when the shaft portion 5B is inserted in the bearing hole 1B.

The recessed groove 8 and the notched grooves 11A are in communication with each other when the input shaft 5 is positioned at a predetermined rotational position. The predetermined rotational position of the input shaft 5 will now be explained. As illustrated in FIG. 2, the input shaft 5 rotates clockwise and anti-clockwise as indicated by an arrow $\alpha$ as the rotation of the key cylinder 2 operated with the key is transmitted to the input shaft 5 through the output shaft 6. Consequently, the link portion 4 moves as indicated by an arrow $\beta$. That is, the link portion 4 is switched to-and-fro the unlocking position and the locking position according to the movement of the input shaft 5. A key hole exposed outside the vehicle, into which the key is inserted, is always at a predetermined rotational position. Accordingly, a direction in which the key is inserted into the key hole is always the same such that operation with the key is facilitated. The predetermined rotational position of the input shaft 5 corresponds to the predetermined rotational position of the key hole of the key cylinder 2. The predetermined rotational position is approximately at a center of a rotational range indicated by the arrow $\alpha$ in the above-described idling range. In other words, a neutral position from which rotational ranges in the idling range are substantially equal in both of directions indicated by the arrow $\alpha$ when the rotation of the key cylinder 2 operated through the key is transmitted to the input shaft 5.

Figure 4A:
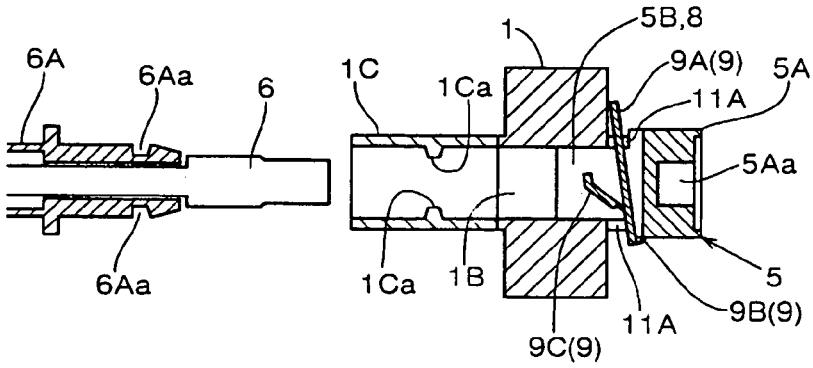
FIGS. 4A to 4D are sectional views of actions related to an engagement between the input shaft and an output shaft according to the first embodiment.
Figure 4B:
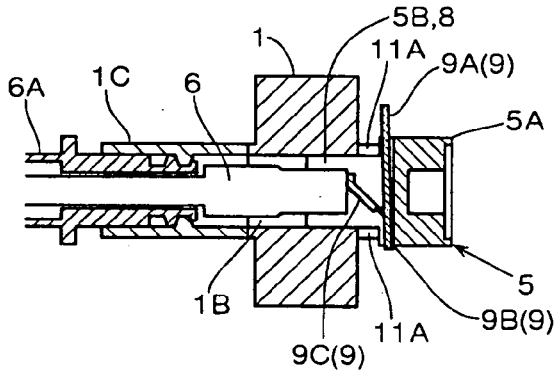
Figure 4C:
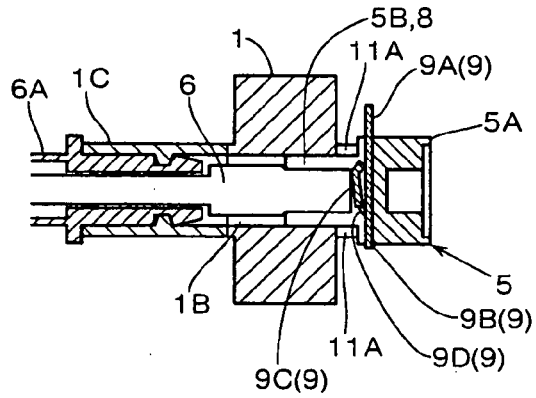
Figure 4D:
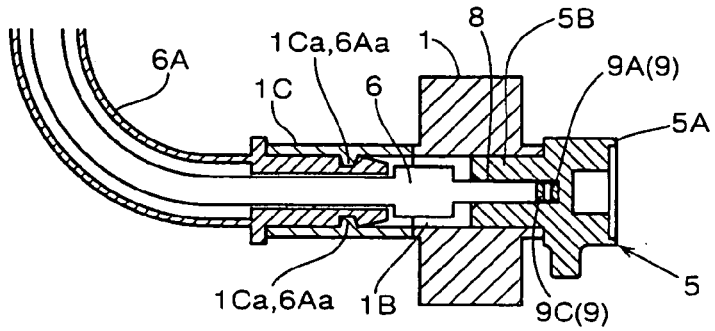

Actions of an engagement of the input shaft 5 and the output shaft 6 will be explained below. FIGS. 4A to 4D are illustrations of cross sections of the actions. FIGS. 4A to 4C are sectional views taken along the recessed groove 8 and the notched grooves 11A, and FIG. 4D is a sectional view taken along a direction orthogonal to FIGS. 4A to 4C.

As illustrated in FIG. 4A, first, the input shaft 5 is inserted into the bearing hole 1B by bending the resilient portion 9B so as to insert the engagement piece 9A of the engagement member 9 in the recessed groove 8. The shaft portion 5B is then inserted in the bearing hole 1B. The recessed groove 8 is communicated with the notched grooves 11A of the cylindrical portion 11 in the bearing hole 1B, so that the rotational base portion 5A abuts on an edge of the cylindrical portion 11. Consequently, the engagement piece 9A is inserted in both the recessed groove 8 and the notched grooves 11A. As a result, since the engagement piece 9A maintains the recessed groove 8 and the notched grooves 11A in communication with each other, the input shaft 5 is retained at the predetermined rotational position so that the rotation of the input shaft 5 is restricted. The abutting piece 9C serving as the abutting portion resiliently projects from the engagement piece 9A in a direction of an end opening of the recessed groove 8 via the resilient portion 9D. The latch mechanism and the lock mechanism are already mounted inside the housing 1 and the door lock device is already in an assembled state, after the input shaft 5 has been inserted in the bearing hole 1B as described above.

As illustrated in FIG. 4B, the output shaft 6 is inserted in the bearing hole 1B from the outside of the housing 1 through the engagement cylinder 1C. The end portion of the output shaft 6 is engaged with the recessed groove 8 of the input shaft 5 and simultaneously pushes the abutting piece 9C of the engagement member 9 toward the bottom portion of the recessed groove 8. Since the resilient portion 9D at the end of the abutting piece 9C has the hardness higher than that of the resilient portion 9B at the end of the engagement piece 9A, only the resilient portion 9B is bent so that the engagement piece 9A is pushed toward the bottom portion of the recessed groove 8. As a result, the engagement piece 9A is pushed out from the notched grooves 11A and the input shaft 5 is disengaged so that the input shaft 5 is then allowed to rotate. In the state illustrated in FIG. 4B, since the output shaft 6 is already engaged with the recessed groove 8 of the input shaft 5, the input shaft 5 is not rotated unless rotation is transmitted from the output shaft 6.

As illustrated in FIG. 4C and FIG. 4D, the output shaft 6 is further inserted toward the bottom portion of the recessed groove 8. Consequently, the engagement grooves 6Aa provided on the outer cylindrical body 6A of the output shaft 6 and the engagement projections 1Ca provided on the engagement cylinder 1C are engaged with each other, so that the output shaft 6 is prevented from falling out of the bearing hole 1B and the engagement of the output shaft 6 with the recessed groove 8 of the input shaft 5 is maintained. The abutting piece 9C is further pushed toward the bottom portion of the recessed groove 8 by the end of the output shaft 6. Since the engagement piece 9A has reached the bottom portion of the recessed groove 8, the resilient portion 9D is bent so as to further push the engagement piece 9A into the recessed groove 8.

In the door lock device according to the first embodiment, the input shaft 5 is retained at the predetermined rotational position by the positioning unit including the recessed groove 8, the notched grooves 11A, and the engagement member 9 until the output shaft 6 and the input shaft 5 are engaged with each other. Rotation of the input shaft 5 is allowed, when the output shaft 6 and the input shaft 5 are engaged with each other. That is, it is possible to prevent the input shaft 5 from rotating within the idling range in the operation of the input shaft 5 before the output shaft 6 and the input shaft 5 are engaged with each other. As a result, when the rotation of the key cylinder 2 operated with the key from the outside is transmitted to the lock mechanism as the rotational drive force, the rotational ranges of the input shaft 5 to the unlocked state and the locked state are not biased. Therefore, according to the door lock device, extents to which the key is operated for locking and for unlocking are prevented from being different to each other without mounting of the door lock device to the door D being complicated.

In particular, the engagement member 9 has the abutting piece 9C serving as the abutting portion projecting resiliently from the engagement piece 9A inserted in the recessed groove 8 and the notched grooves 11A toward the end opening at the end of the recessed groove 8. When the output shaft 6 is inserted in and engaged with the recessed groove 8, the abutting piece 9C abuts on the output shaft 6 so as to push the engagement piece 9A out from the notched grooves 11A. Further, the abutting piece 9C further pushes the engagement pieces 9A in the recessed groove 8 with the resiliency of the resilient portion 9D as the output shaft 6 is inserted further in the recessed groove 8 so as to always apply a force to the engagement piece 9A for pushing the engagement piece 9A out from the notched grooves 11A. As a result, the engagement member 9 is infallibly pushed out from the notched grooves 11A and is held pushed out.

A second embodiment of a door lock device according to the present invention will be described in detail below with reference to the accompanying drawings. In the second embodiment, only a structure of an engagement member is different from that of the first embodiment. Therefore, in the second embodiment, the same reference signs are designated to portions that are equal to those of the first embodiment, and descriptions thereof are omitted.

Figure 5:
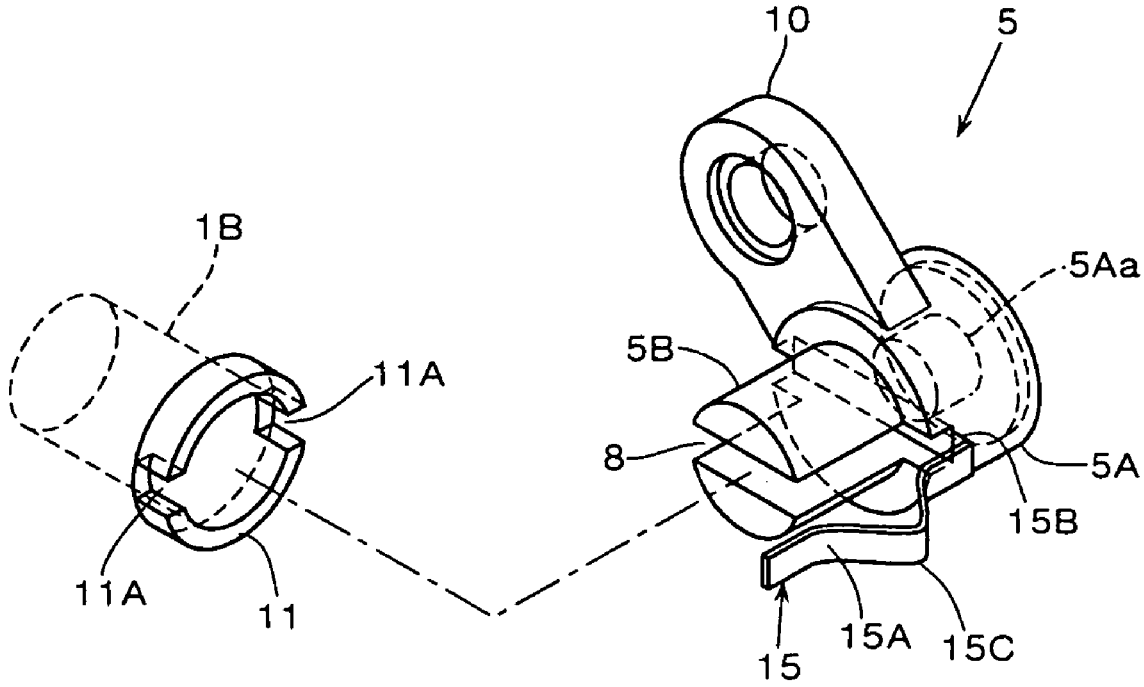
FIG. 5 is a perspective view of an input shaft and a bearing hole according to a second embodiment of the present invention.

FIG. 5 is a perspective view of an input shaft and a bearing hole in the second embodiment. As illustrated in FIG. 5, an engagement member 15 as an element of a positioning unit is provided on an outer peripheral portion of the rotational base portion 5A. The engagement member 15 has an engagement piece 15A which can be inserted through the recessed groove 8 so as to penetrate the recessed groove 8 from the side of the opening to the other side of the opening of the recessed groove 8. The engagement piece 15A is cantilevered with its end connected, via a resilient portion 15B, to an edge of the side opening of the recessed groove 8. The edge is continuous with the bottom portion of the recessed groove 8. The engagement piece 15A has a hardness higher than that of the resilient portion 15B and is less flexible than the resilient portion 15B. Further, a convex bent portion 15C serving as an abutting portion and formed as a bent portion of the engagement piece 15A is provided in an intermediate portion of the engagement piece 15A. The convex bent portion 15C is provided such that a top portion of the convex bent portion 15C is oriented toward the end of the shaft portion 5B and located within the recessed groove 8, when the engagement piece 15A is inserted in the recessed groove 8.

Figure 6A:
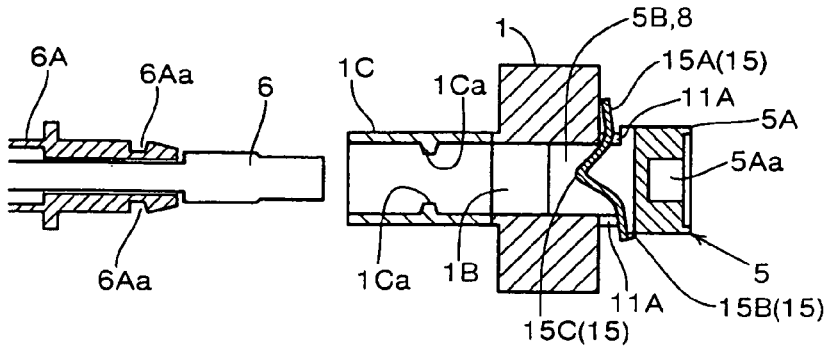
FIGS. 6A to 6D are sectional views of actions related to an engagement between the input shaft and an output shaft according to the second embodiment.
Figure 6B:
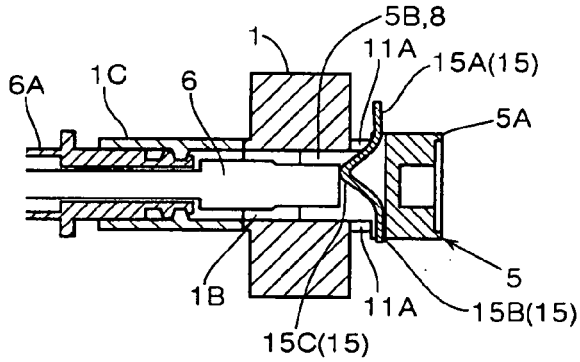
Figure 6C:
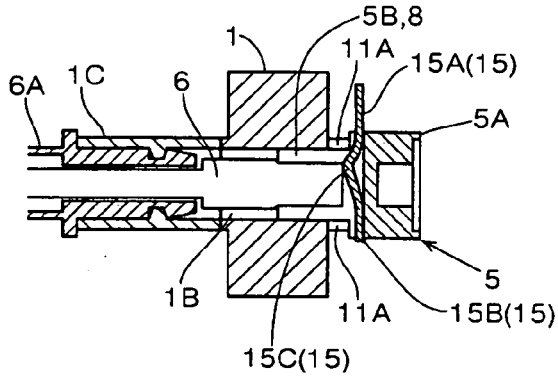
Figure 6D:
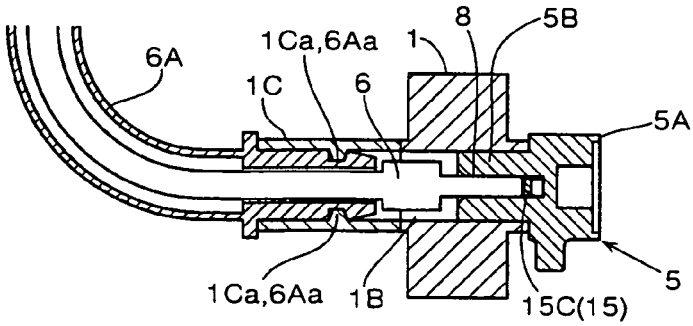

Actions related to an engagement of the input shaft 5 and the output shaft 6 according to the second embodiment will be explained below. FIGS. 6A to 6D are sectional views of the actions. FIGS. 6A to 6C are sectional views taken along the recessed groove 8 and the notched grooves 11A, and FIG. 6D is a sectional view taken along a direction orthogonal to FIGS. 6A to 6C.

As illustrated in FIG. 6A, first, the input shaft 5 is inserted in the bearing hole 1B. The resilient portion 15B is bent so as to insert the input shaft 5 in the bearing hole 1B as the engagement piece 15A of the engagement member 15 is inserted through the recessed groove 8. The shaft portion 5B is then inserted in the bearing hole 1B. The recessed groove 8 is communicated with the notched grooves 11A of the cylindrical portion 11 in the bearing hole 1B, so that the rotational base portion 5A abuts on the edge of the cylindrical portion 11. Consequently, the engagement piece 15A is positioned and inserted through both the recessed groove 8 and the notched grooves 11A. As a result, since the engagement piece 15A maintains the recessed groove 8 and the notched grooves 11A in communication with each other, rotation of the input shaft 5 is restricted so as to retain the input shaft 5 at the predetermined rotational position. The convex bent portion 15C serving as the abutting portion then resiliently projects from the engagement piece 15A toward the end opening at the end of the recessed groove 8 because of a resiliency of the convex bent portion 15C. When the input shaft 5 has been inserted in the bearing hole 1B as described above, the latch mechanism and the lock mechanism are already mounted inside the housing 1 and the door lock device is already in an assembled state.

As illustrated in FIG. 6B, the output shaft 6 is inserted in the bearing hole 1B from the outside of the housing 1 through the engagement cylinder 1C. The end portion of the output shaft 6 is engaged with the recessed groove 8 of the input shaft 5 and simultaneously pushes the convex bent portion 15C of the engagement member 15 toward the bottom portion of the recessed groove 8. Since the engagement piece 15A of the convex bent portion 15C has the hardness higher than that of the resilient portion 15B at the end of the engagement piece 15A, only the resilient portion 15B is bent so that the engagement piece 15A is pushed toward the bottom portion of the recessed groove 8. As a result, the engagement piece 15A is pushed out from the notched grooves 11A and the input shaft 5 is disengaged so that the input shaft 5 is allowed to rotate. In the state illustrated in FIG. 6B, since the output shaft 6 is already engaged with the recessed groove 8 of the input shaft 5, the input shaft 5 is not rotated unless rotation is transmitted from the output shaft 6.

As illustrated in FIG. 6C and FIG. 6D, the output shaft 6 is further inserted toward the bottom portion of the recessed groove 8. Consequently, the engagement groove 6Aa provided on the outer cylindrical body 6A of the output shaft 6 and the engagement projection 1Ca of the engagement cylinder 1C are engaged with each other, so that the output shaft 6 is prevented from falling out of the bearing hole 1B and the engagement of the output shaft 6 with the recessed groove 8 of the input shaft 5 is maintained. That is, the convex bent portion 15C is further pushed toward the bottom portion of the recessed groove 8 by the end of the output shaft 6. Since the engagement piece 15A has reached the bottom portion of the recessed groove 8, the convex bent portion 15C is bent so as to further push the engagement piece 15A into the recessed groove 8.

In the door lock device according to the second embodiment, the input shaft 5 is retained at the predetermined rotational position by the positioning unit including the recessed groove 8, the notched grooves 11A, and the engagement member 15 until the output shaft 6 and the input shaft 5 are engaged with each other. Rotation of the input shaft 5 is allowed, when the output shaft 6 and the input shaft 5 are engaged with each other. That is, it is possible to prevent the input shaft 5 from rotating within the idling range in the operation of the input shaft 5, before the output shaft 6 and the input shaft 5 are engaged with each other. As a result, when rotation of the key cylinder 2 operated with the key from the outside is transmitted to the lock mechanism as a rotational drive force, the rotational ranges of the input shaft 5 to the unlocked state and the locked state are not biased. Therefore, according to the door lock device, extents to which the key is operated for locking and for unlocking are prevented from being different to each other without a mounting process of the door lock device to the door D being complicated.

In particular, the engagement member 15 has the convex bent portion 15C serving as the abutting portion projecting resiliently from the engagement piece 15A inserted through the recessed groove 8 and the notched grooves 11A toward the end opening at the end of the recessed groove 8. When the output shaft 6 is inserted in and engaged with the recessed groove 8, the convex bent portion 15C abuts on the output shaft 6 so as to push the engagement piece 15A out from the notched grooves 11A. Further, the convex bent portion 15C further pushes the engagement pieces 15A in the recessed groove 8 with the resiliency of the convex bent portion 15C as the output shaft 6 is inserted further in the recessed groove 8 so as to always apply a force to the engagement piece 15A for pushing the engagement piece 15A out from the notched grooves 11A. As a result, the engagement member 15 is infallibly pushed out from the notched grooves 11A and is held pushed out.

A third embodiment of a door lock device according to the present invention will be described in detail below with reference to the accompanying drawings. In the third embodiment, only a structure of a positioning unit is different from that of the first embodiment. Therefore, in the third embodiment, the same reference signs are designated to portions identical to those of the first embodiment, and descriptions thereof are omitted.

Figure 7A:
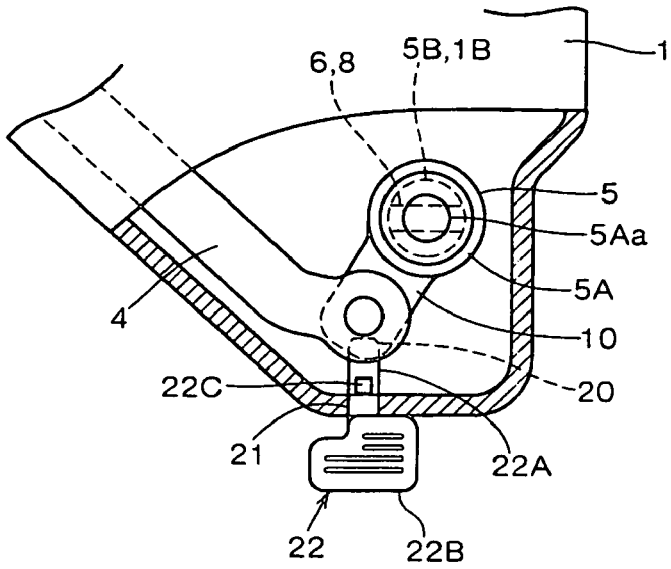
FIG. 7A is an illustration of a portion of a door lock device according to a third embodiment of the present invention, which is viewed from inside a vehicle.
Figure 7B:
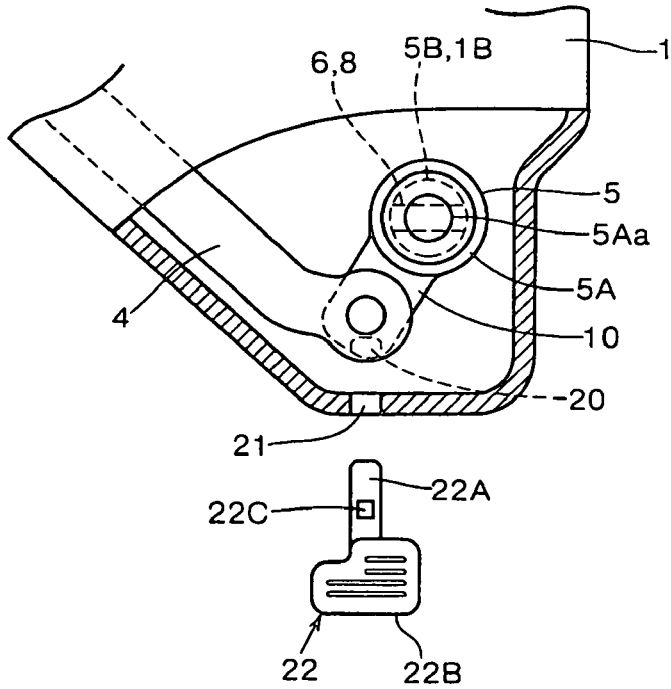
FIG. 7B is an illustration of an action of the portion of the door lock device according to the third embodiment.

FIG. 7A is an illustration of a portion of the door lock device which is viewed from inside the vehicle, and FIG. 7B is an illustration of an action related to the door lock device. The positioning unit in the third embodiment includes a fitting portion 20, an insertion hole portion 21, and an engagement member 22. The fitting portion 20 is provided on the coupling arm member 10 of the input shaft 5, and is concaved. The insertion hole portion 21 penetrates through the housing 1, and is provided at a position opposed to the fitting portion 20 when the input shaft 5 is positioned at a predetermined rotational position. The engagement member 22 has a rod-shaped fitting and inserting portion 22A, which is inserted in the fitting portion 20 and through the insertion hole portion 21 when the fitting portion 20 and the insertion hole portion 21 are opposed to each other. For inserting the fitting and inserting portion 22A into the fitting portion 20 via the insertion hole portion 21 from the outside of the housing 1, the fitting and inserting portion 22A has a pick-up portion 22B at an end of the fitting and inserting portion 22A, which can be picked by fingers or the like. Further, the fitting and inserting portion 22A has an engagement portion 22C for maintaining the fitting and inserting portion 22A inserted, when the fitting and inserting portion 22A has been inserted in both the fitting portion 20 and the insertion hole portion 21. In this embodiment, the engagement portion 22C is a pawl piece configured to engage with an edge of the insertion hole portion 21 inside the housing 1. The engagement portion 22C may be configured to be engaged with the fitting portion 20 instead.

Actions regarding the engagement of the input shaft 5 and the output shaft 6 will be explained below. First, FIG. 7A is an illustration of a state in which the input shaft 5 is inserted in the bearing hole 1B. In this state, the input shaft 5 is positioned at the predetermined rotational position so that the fitting portion 20 and the insertion hole portion 21 are opposed to each other. The fitting and inserting portion 22A of the engagement member 22 is inserted in the fitting portion 20 through the insertion hole portion 21. The fitting and inserting portion 22A is maintained inserted by the engagement portion 22C. As a result, since the fitting and inserting portion 22A maintains the fitting portion 20 and the insertion hole portion 21 opposed to each other, the input shaft 5 is retained at the predetermined rotational position. When the input shaft 5 has been inserted in the bearing hole 1B as described above, the latch mechanism and the lock mechanism are already mounted inside the housing 1 and the present door lock device is in an assembled state.

As illustrated in FIG. 7B, the output shaft 6 is inserted in the bearing hole 1B from the outside of the housing 1. The end portion of the output shaft 6 is engaged with the recessed groove 8 of the input shaft 5. Subsequently, the pick-up portion 22B of the engagement member 22 is picked by fingers or the like so that the fitting and inserting portion 22A are pulled out of the fitting portion 20 and through the insertion hole portion 21. As a result, the input shaft 5 is disengaged so that rotation of the input shaft 5 is allowed.

In the door lock device according to the third embodiment, the input shaft 5 is retained at the predetermined rotational position by the positioning unit including the fitting portion 20, the insertion hole portion 21, and the engagement member 22. After the output shaft 6 and the input shaft 5 are engaged with each other, the positioning unit is removed such that rotation of the input shaft 5 is allowed. Therefore, it is possible to prevent the input shaft 5 from rotating within the idling range provided for operation of the input shaft 5 before the output shaft 6 and the input shaft 5 are engaged with each other. As a result, when rotation of the key cylinder 2 operated through the key from the outside is transmitted to the lock mechanism as a rotational drive force, the rotational ranges of the input shaft 5 to the unlocked state and the locked state are prevented from being unbalanced. Therefore, in the door lock device, extents to which the key is rotated for locking and for unlocking are prevented from being different from each other without an assembly process of the door lock device to the door D being complicated.

In all the embodiments described above, the end portion of the output shaft 6 may have, for example, a cross section having an approximate cross shape instead of the approximate straight line shape. The shaft portion 5B engaged with the output shaft 6 is then provided with a groove approximately cross-shaped and dividing longitudinally the shaft portion 5B into four by adding a groove orthogonal to the recessed groove 8.

According to the present invention, the engagement piece positioned in both the recessed groove and the notched grooves is partially pushed out from the notched grooves by the output shaft, when the output shaft is engaged with the recessed groove. Therefore, the input shaft and the output shaft can be coupled to each other by simply engaging by the insertion described above the output shaft with the door lock device, which has been assembled in advance.

Further, the engagement member inserted in the fitting portion and through the insertion hole portion may be simply pulled out of the door lock device after the output shaft and the input shaft are engaged with each other. Therefore, the input shaft and the output shaft can be coupled to each other by merely engaging the output shaft by the insertion described above with the door lock device which has been assembled in advance and by merely pulling the engagement member out of the door lock device.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A door lock device comprising:

a lock mechanism configured to allow opening of a door operated by a handle in an unlocked state and to not allow the opening in a locked state;

an input shaft configured to switch the lock mechanism between the unlocked state and the locked state when a rotational drive force is applied to the input shaft, the input shaft with which an output shaft is to be engaged so that the rotational drive force is transmitted to the input shaft, the output shaft to be rotated by an operation with a key from outside the door; and a positioning mechanism, comprising a resilient engagement structure oriented to be moveable by said output shaft and engagable with said input shaft and configured to hold the input shaft at a predetermined rotational position until the output shaft has been engaged with the input shaft and to allow rotation of the input shaft when the output shaft and the input shaft have been engaged with each other.

2. A door lock device comprising:

a lock mechanism configured to allow opening of a door operated by a handle in an unlocked state and to not allow the opening in a locked state;

an input shaft configured to switch the lock mechanism between the unlocked state and the locked state when a rotational drive force is applied to the input shaft, the input shaft with which an output shaft is to be engaged so that the rotational drive force is transmitted to the input shaft, the output shaft to be rotated by an operation with a key from outside the door; and a positioning mechanism configured to hold the input shaft at a predetermined rotational position until the output shaft has been engaged with the input shaft and to allow rotation of the input shaft when the output shaft and the input shaft have been engaged with each other, wherein the positioning mechanism comprises:

a recessed groove provided in the input shaft;

a notched groove provided in a housing configured to rotatably support the input shaft inserted in the housing, and configured to communicate with the recessed groove when the input shaft is in the predetermined rotational position; and an engagement piece configured to be placed in both the recessed groove and the notched groove communicated with each other so as to restrict the rotation of the input shaft until the output shaft and the input shaft have been engaged with each other, and pushed out from the notched groove so as to allow the rotation of the input shaft when the output shaft has been engaged with the recessed groove of the input shaft.

3. The door lock device according to claim 2, wherein the positioning mechanism comprises:

an abutting portion configured to project resiliently from the engagement piece towards an opening of the recessed groove until the output shaft and the input shaft have been engaged with each other, and to abut on the output shaft so as to push the engagement piece out from the notched groove when the output shaft is inserted in the recessed groove so as to be engaged with the recessed groove.

4. A door lock device comprising:

a lock mechanism configured to allow opening of a door operated by a handle in an unlocked state and to not allow the opening in a locked state;

an input shaft configured to switch the lock mechanism between the unlocked state and the locked state when a first rotational drive force generated by an operation with a key from outside the door is applied to the input shaft via an output shaft;

a positioning mechanism including a plurality of engagement portions configured to engage with each other and to restrict rotation of the input shaft until the output shaft has been engaged with the input shaft so as to engage the output shaft and the input shaft at a predetermined rotational position; wherein a second rotational drive force generated by a lock operation from inside the door is applied to the lock mechanism so as to switch the lock mechanism between the unlocked state and the locked state, and the second rotational drive force applied to the lock mechanism is not transmitted to the input shaft.

5. The door lock device according to claim 4, comprising:

wherein the positioning mechanism is configured to restrict the rotation of the input shaft by holding the input shaft at the predetermined rotational position until the output shaft and the input shaft have been engaged with each other, and to allow the rotation of the input shaft when the output shaft and the input shaft have been engaged with each other.

6. The door lock device according to claim 5, wherein the positioning mechanism comprises as the engagement portions:

a recessed groove provided in the input shaft;

a notched groove provided in a housing configured to rotatably support the input shaft inserted in the housing, and configured to communicate with the recessed groove when the input shaft is in the predetermined rotational position; and an engagement piece configured to be placed in both the recessed groove and the notched groove communicated with each other so as to restrict the rotation of the input shaft until the output shaft and the input shaft have been engaged with each other, and pushed out from the notched groove so as to allow the rotation of the input shaft when the output shaft has been engaged with the recessed groove of the input shaft.

7. The door lock device according to claim 6, wherein the positioning mechanism comprises as the engagement portions:

an abutting portion configured to project resiliently from the engagement piece towards an opening of the recessed groove until the output shaft and the input shaft have been engaged with each other, and to abut on the output shaft so as to push the engagement piece out from the notched groove when the output shaft is inserted in the recessed groove so as to be engaged with the recessed groove.

8. The door lock device according to claim 4, wherein at least one of the engagement portions is configured to be attachable and detachable to and from the door lock device.

9. The door lock device according to claim 8, wherein the positioning mechanism comprises as the engagement portions:

a fitting portion provided at the input shaft;

a hole portion penetrating through a housing accommodating the lock mechanism and configured to rotatably support the input shaft, and configured to be opposed to the fitting portion when the input shaft is in the predetermined rotational position; and an engagement member configured to be fitted into both the fitting portion and the hole portion opposed to each other so as to restrict the rotation of the input shaft, and pulled out of the housing so as to allow the rotation of the input shaft after the input shaft is engaged with the output shaft.

* * * * *